US010339863B2

(12) United States Patent
Zhu et al.

(10) Patent No.: US 10,339,863 B2
(45) Date of Patent: Jul. 2, 2019

(54) PIXEL CIRCUIT, DISPLAY DEVICE, AND DRIVE METHOD THEREFOR

(71) Applicants: KUNSHAN NEW FLAT PANEL DISPLAY TECHNOLOGY CENTER CO., LTD., KunShan, Jiangsu (CN); KUNSHAN GO-VISIONOX OPTO-ELECTRONICS CO., LTD., KunShan, Jiangsu (CN)

(72) Inventors: Hui Zhu, Jiangsu (CN); Yong Qiu, Beijing (CN); Xiuqi Huang, Jiangsu (CN); Xiaoyu Gao, Jiangsu (CN); Siming Hu, Jiangsu (CN); Zhenzhen Han, Jiangsu (CN)

(73) Assignees: Kunshan New Flat Panel Display Technology Center Co., Ltd., Kunshan, Jiangsu (CN); Kunshan Go-Visionox Opto-Electronics Co., Ltd., Kunshan, Jiangsu (CN)

( * ) Notice: Subject to any disclaimer, the term of this patent is extended or adjusted under 35 U.S.C. 154(b) by 0 days.

(21) Appl. No.: 14/758,403

(22) PCT Filed: Dec. 20, 2013

(86) PCT No.: PCT/CN2013/090103

§ 371 (c)(1),
(2) Date: Jun. 29, 2015

(87) PCT Pub. No.: WO2014/101719

PCT Pub. Date: Jul. 3, 2014

(65) Prior Publication Data

US 2015/0356922 A1 Dec. 10, 2015

(30) Foreign Application Priority Data

Dec. 31, 2012 (CN) ..... 2012 1 0587996

(51) Int. Cl.

| | |
|---|---|
| ***G09G 3/3233*** | (2016.01) |
| ***G09G 3/3258*** | (2016.01) |
| ***G09G 3/3291*** | (2016.01) |

(52) U.S. Cl.
CPC ..... *G09G 3/3258* (2013.01); *G09G 3/3233* (2013.01); *G09G 3/3291* (2013.01);
(Continued)

(58) Field of Classification Search
None
See application file for complete search history.

(56) References Cited

U.S. PATENT DOCUMENTS

2001/0028248 A1 10/2001 Nekado
2002/0140642 A1* 10/2002 Okamoto ..... G09G 3/3258 345/76

(Continued)

FOREIGN PATENT DOCUMENTS

CN 1542718 A 11/2004
CN 1599518 A 3/2005

(Continued)

*Primary Examiner* — Matthew Yeung
(74) *Attorney, Agent, or Firm* — Muncy, Geissler, Olds & Lowe, P.C.

(57) ABSTRACT

A pixel circuit, a display device, and a drive method therefor. The pixel circuit comprises: a first power source (ELVDD), a second power source (ELVSS), an organic light-emitting diode (OLED), a first capacitor (C1), a first transistor (T1), a second transistor (T2), and a third transistor (T3), wherein the first transistor (T1) is configured to compensate a threshold voltage of the third transistor (T3). According to the drive method, the pixel circuit is driven to emit light by sequentially applying scanning signals to the pixel circuit on scanning lines (Sn1, Sn2, Sn3). The pixel circuit and the method for driving the pixel circuit can improve the response characteristics of active matrix organic light-emitting diodes, thereby enabling the display device to display images having uniform image quality.

23 Claims, 8 Drawing Sheets

(52) U.S. Cl.
CPC ..... *G09G 2300/0814* (2013.01); *G09G 2300/0819* (2013.01); *G09G 2300/0842* (2013.01); *G09G 2300/0852* (2013.01); *G09G 2300/0861* (2013.01); *G09G 2310/0251* (2013.01); *G09G 2310/0262* (2013.01); *G09G 2320/043* (2013.01); *G09G 2330/028* (2013.01)

(56) References Cited

U.S. PATENT DOCUMENTS

2003/0020413 A1* 1/2003 Oomura ..... G09G 3/3241 315/169.3
2003/0132931 A1 7/2003 Kimura et al.
2003/0189206 A1 10/2003 Koyama
2004/0150595 A1* 8/2004 Kasai ..... G09G 3/2011 345/82
2005/0017934 A1* 1/2005 Chung ..... G09G 3/3233 345/82
2005/0140605 A1* 6/2005 Jung ..... G09G 3/3233 345/76
2006/0007078 A1* 1/2006 Lee ..... G09G 3/3233 345/82
2006/0082524 A1 4/2006 Kwon
2006/0170628 A1* 8/2006 Yamashita ..... G09G 3/3233 345/76
2007/0126663 A1* 6/2007 Kim ..... G09G 3/3241 345/76
2007/0273622 A1* 11/2007 Huang ..... G09G 3/3241 345/76
2008/0094322 A1* 4/2008 Sarma ..... G02F 1/133305 345/76
2009/0273590 A1* 11/2009 Tanikame ..... G09G 3/3233 345/211
2009/0284501 A1* 11/2009 Nathan ..... G09G 3/3233 345/204
2010/0127955 A1 5/2010 Choi
2013/0235022 A1* 9/2013 Tanikame ..... G09G 3/3233 345/212

FOREIGN PATENT DOCUMENTS

CN 1612194 A 5/2005
CN 1223979 C 10/2005
CN 101847365 A 9/2010
CN 102254510 A 11/2011
CN 102290027 A 12/2011
CN 103021339 A 4/2013
EP 2146337 A1 1/2010
JP 11-272233 A 10/1999
JP 2003-202833 A 7/2003
JP 2006-119180 A 5/2006
TW I354251 B 12/2011
TW 201243803 A 11/2012
TW 201250657 A 12/2012

* cited by examiner

PIXEL CIRCUIT, DISPLAY DEVICE, AND DRIVE METHOD THEREFOR

TECHNICAL FIELD

The present invention relates to a pixel circuit, a display device and a method for driving the pixel circuit, and more particularly relates to a pixel circuit of an organic light-emitting diode capable of compensating a threshold voltage of a driving transistor, a display device and a method for driving the pixel circuit.

BACKGROUND

In recent years, various types of flat panel display devices, which have light weight and small size compared with cathode ray tube (CRT) displays, have been developed. Among the various types of flat panel display devices, by using a self-light-emitting organic light-emitting diode (OELD) to display images, an active matrix organic light-emitting display device with a thin-film transistor (TFT) backplane usually has the characteristics of short response time, low power consumption for driving, and better brightness and color purity. Therefore, the organic light-emitting display device has become a focus of the next-generation display devices.

FIG. 1 schematically shows a circuit diagram of a traditional active matrix organic light-emitting display device 100, wherein the active matrix organic light-emitting display device 100 comprises a data driver and a scanning driver (not shown in FIG. 1). The data driver is configured to control a plurality of data lines DA1 . . . DAm in transversal arrangement, and the scanning driver is configured to control a plurality of scanning lines SC1 . . . SCn in longitudinal arrangement. A plurality of pixel circuits 110 are formed in intersection areas between the plurality of data lines DA1 . . . DAm and the plurality of scanning lines SC1 . . . SCn.

With reference to FIG. 1, the pixel circuit 110 comprises an organic light-emitting diode (OLED)1, a storage capacitor C11, a switching transistor T11, a driving transistor T12, a first power source ELVDD1, and a second power source ELVSS1, wherein both the transistors T11 and T12 are P-channel metal-oxide semiconductor transistors (PMOS). A grid of the switching transistor of the switching transistor T11 is coupled to one scanning line SC1, a source of the switching transistor T11 is coupled to one data line DA1, and a drain of the switching transistor T11 is coupled to a grid of the second transistor T12. A source of the driving transistor T12 is coupled to the high-voltage power source ELVDD1, and a drain of the driving transistor T12 is coupled to an anode of the OLED1. A cathode of the OLED1 is coupled to the low-voltage power source ELVSS1. A first terminal of the storage capacitor C11 is coupled to the first power source ELVDD1, and a second terminal of the storage capacitor C11 is coupled to the grid of the second transistor.

The scanning driver applies scanning signals to the scanning lines SC1 to SCn in sequence, and the data driver applies corresponding data signals via the data lines DA1 to DAm according to image data to be displayed. Thus, the pixel circuits 110 located in the intersection areas supply a driving current flowing through the organic light-emitting diode according to the signals of the scanning lines and data lines coupled to the pixel circuits.

Using the pixel circuit 110 shown in FIG. 1 as an example, when the scanning drive applies the scanning signals to the scanning line SC1, the switching transistor T11 is conducted, and at this point, a voltage of the data signals on the data line DA1 is stored in the storage capacitor C11 through the switching transistor T11. The driving transistor T12 supplies a driving current $I_{OLED1}$ according to the voltage stored in the storage capacitor C11 to drive the organic light-emitting diode OLED1 to emit the light of the corresponding brightness. A formula for the driving current is shown as below:

$$I_{OLED1}=\tfrac{1}{2}\mu_{12}\times C_{ox12}\times W_{12}/L_{12}(V_{GS12}-V_{TH12})^2 \quad \text{(Formula 1)},$$

wherein $\mu_{12}$ is a carrier mobility of the driving transistor T12, $C_{ox12}$ is a capacitance of a control end oxidation layer per unit area of the driving transistor T12, $W_{12}$ is a channel width of the driving transistor T12, $L_{12}$ is a channel length of the driving transistor T12, $V_{GS12}$ is a voltage difference between the grid and the source of the driving transistor T12, and $V_{TH12}$ is a threshold voltage of the driving transistor T12. That is, the driving current flowing through the organic light-emitting diode OLED1 can be controlled according to the magnitude of a data voltage from the data line DA1 to display a predefined grayscale.

A large active matrix organic light-emitting display device comprises a number of pixel circuits, and each of which need to comprise a driving transistor. The electric difference among different driving transistors results in different threshold voltages on the driving transistors. Therefore, according to the formula 1, it can be known that when the data voltages supplied to the pixel circuits 110 are the same, the driving currents supplied to the organic light-emitting diodes may vary with different threshold voltages of the driving transistors. This will result in the problems of poor quality uniformity and poor consistency of an image displayed by a plurality of pixel circuits.

SUMMARY

In view of this, a main objective of the present invention is to provide a novel pixel circuit structure capable of compensating a difference in a threshold voltage of the driving transistor. The present invention provides a pixel circuit capable of producing a desired brightness and an active matrix organic light-emitting display device employing the pixel circuit, wherein the pixel circuit is capable of improving the response characteristic of the active matrix organic light-emitting diode to display the image with uniform image quality.

To achieve the above objective, technical solutions of the present invention are implemented as follows:

The present invention provides a pixel circuit, comprising: a first power source, a second power source, an organic light-emitting diode, a first capacitor, a first transistor, a second transistor, and a third transistor; wherein a cathode of the organic light-emitting diode is coupled to the second power source;

the first capacitor is coupled between a node and the second power source;

each of the first transistor, the second transistor, and the third transistor is provided with a control end, a first electrode, and a second electrode;

the control end of the first transistor is coupled with the node, and the first electrode of the first transistor is configured to receive a data signal;

the control end of the second transistor is configured to receive a first scanning signal, the first electrode of the second transistor is coupled to the second electrode of the first transistor, and the second electrode of the second transistor is coupled to the node;

the control end of the third transistor is coupled to the node, the first electrode of the third transistor is coupled to the first power source, and the second electrode of the third transistor is coupled to an anode of the light-emitting diode; and the first transistor is configured to compensate a threshold voltage of the third transistor.

The first transistor and the third transistor are approximate in channel width, and are arranged in the pixel circuit in a close range.

The pixel circuit is arranged on a TFT backplane; and the first transistor and the third transistor are symmetrically arranged on the TFT backplane.

The pixel circuit further comprises a fourth transistor;

wherein a control end of the fourth transistor is configured to receive a second scanning signal, a first electrode of the fourth transistor is coupled to the second electrode of the third transistor, and a second electrode of the fourth transistor is coupled to an anode of the light-emitting diode.

The pixel circuit further comprises a fifth transistor and a third power source;

wherein the fifth transistor comprises: a control end configured to receive a third scanning signal, a first electrode coupled to the node, and a second electrode coupled to the third power source.

A voltage of the third power source is lower than or equal to a voltage of the second power source.

The pixel circuit further comprises a sixth transistor;

wherein the sixth transistor comprises: a control end configured to receive the third scanning signal, a first electrode coupled to the anode of the light-emitting diode, and a second electrode coupled to the second power source.

The pixel circuit further comprises a second capacitor coupled between the control end of the second transistor and the node.

The first transistor, the second transistor, the third transistor, the fourth transistor, the fifth transistor, and the sixth transistor are P-channel metal-oxide semiconductor transistors.

The present invention further provides a method for driving a pixel circuit; wherein the pixel circuit comprises: a first transistor, a second transistor, a third transistor, a storage capacitor and an organic light-emitting diode, and is driven by signals from data lines and scanning lines; and the drive method comprises:

applying a first scanning signal to a first scanning line for conducting the second transistor such that data signals from a data line are provided to a node via the first transistor and the second transistor, and storing a voltage at the node in the storage capacitor, wherein a control end of the first transistor and a terminal of the storage capacitor are jointly coupled to the node;

providing the data signals to the light-emitting diode via the third transistor; and emitting, by the light-emitting diode, light with a brightness matching the data signals.

The pixel circuit further comprises a fourth transistor; and the method further comprises:

applying a second scanning signal to a second scanning line for conducting the fourth transistor such that the data signals are provided to the light-emitting diode via the third transistor.

The pixel circuit further comprises a fifth transistor; and a third scanning signal is applied for conducting the fifth transistor before the first scanning signal is applied, thereby initializing the node.

The first transistor and the third transistor are approximate in channel width, and are arranged in the pixel circuit in a close range.

The pixel circuits arranged on a TFT backplane; and the first transistor and the third transistor are symmetrically arranged on the TFT backplane.

The present invention further provides a display device, comprising:

A scanning driver is configured to apply a scanning signal to a scanning line;

a data driver is configured to apply a data signal to a data line; and a pixel circuit is coupled between the data line and the scanning line;

wherein the pixel circuit comprises: a first power source, a second power source, an organic light-emitting diode, a first capacitor, a first transistor, a second transistor, and a third transistor; wherein the organic light-emitting diode comprises an anode and a cathode which is coupled to the second power source;

the first capacitor is coupled between a node and the second power source;

each of the first transistor, the second transistor, and the third transistor is provided with a control end, a first electrode, and a second electrode; wherein the control end of the first transistor is coupled to the node, and the first electrode of the first transistor is coupled to with the data lines;

the control end of the second transistor is coupled to a first scanning line, the first electrode of the second transistor is coupled to the second electrode of the first transistor, and the second electrode of the second transistor is coupled to the node;

the control end of the third transistor is coupled to the node, the first electrode of the third transistor is coupled to the first power source, and the second electrode of the third transistor is coupled to an anode of the light-emitting diode; and the first transistor is configured to compensate a threshold voltage of the third transistor.

The first transistor and the third transistor are approximate in channel width, and are arranged in the pixel circuit in a close range.

The display device further comprises a TFT backplane, the pixel circuit being arranged on the TFT backplane; and the first transistor and the third transistor are symmetrically arranged on the TFT backplane.

The pixel circuit further comprises a fourth transistor; wherein a control end of the fourth transistor is coupled to a second scanning line, a first electrode of the fourth transistor is coupled to the second electrode of the third transistor, and a second electrode of the fourth transistor is coupled to the anode of the light-emitting diode.

The pixel circuit further comprises a fifth transistor and a third power source; wherein the fifth transistor comprises a control end coupled to a third scanning line, a first electrode coupled to the node, and a second electrode coupled to the third power source.

A voltage of the third power source is lower than or equal to a voltage of the second power source.

The pixel circuit further comprises a sixth transistor; wherein the sixth transistor comprises: a control end coupled to the third scanning line, a first electrode coupled to the anode of the light-emitting diode, a second electrode coupled to the second power source.

The pixel circuit further comprises a second capacitor coupled between the control end of the second transistor and the node.

The first transistor, the second transistor, the third transistor, the fourth transistor, the fifth transistor, and the sixth transistor are P-channel metal-oxide semiconductor transistors.

DETAILED DESCRIPTION

In the following, the pixel circuit and the method for driving the pixel circuit according to the present invention will be further described in detail with reference to the appended drawings and the embodiments of the present invention.

It is necessary to note that the term "coupled/couple/coupling" as referred to in the present invention includes either direct connection between elements or connection between elements via other components.

For ease of description, a pixel circuit and a method for driving the pixel circuit according to an embodiment of the present invention will be described with reference to FIG. 2 and FIG. 3.

Figure 1:
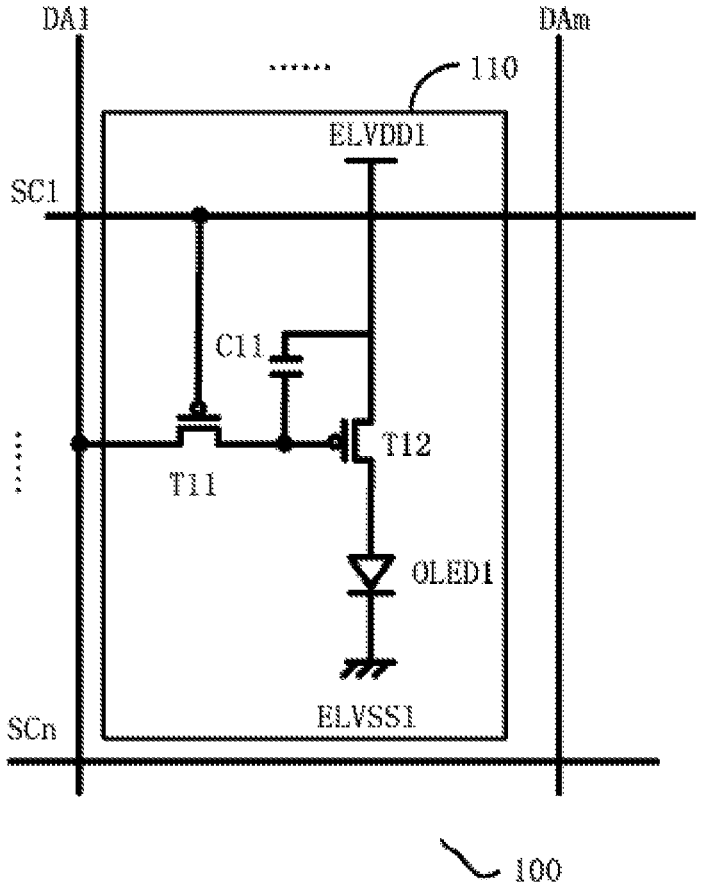
FIG. 1 is a diagram of a pixel circuit of a traditional active matrix organic light-emitting display device.
Figure 2:
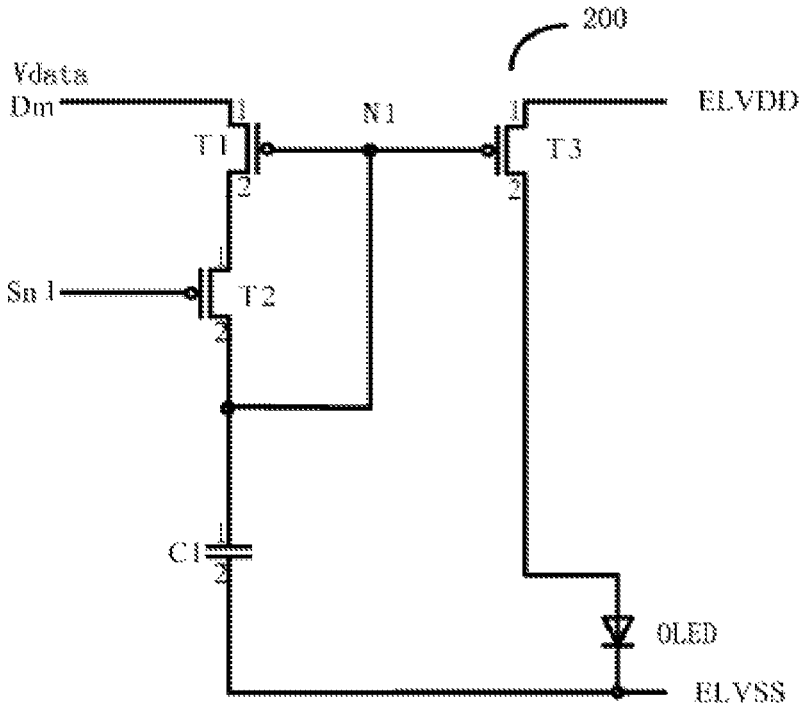
FIG. 2 is a schematic diagram of a pixel circuit according to a first embodiment of the present invention.

FIG. 2 shows a schematic diagram of a pixel circuit 200 according to a first embodiment of the present invention.

With reference to FIG. 2, the pixel circuit 200 comprises: a first transistor T1, a second transistor T2, a third transistor T3, a capacitor C1, and an organic light-emitting diode (OLED). Each of the transistors T1 to T3 comprises a control end, a first electrode 1, and a second electrode 2. The first electrode of the first transistor T1 is coupled to a data line Dm, the control end of the first transistor T1 is coupled to a node N1, and the second electrode of the first transistor T1 is coupled to the first electrode of the second transistor T2. The control end of the second transistor T2 is coupled to a first scanning line Sn1 configured to receive a first scanning signal from the first scanning line Sn1, the first electrode of the second transistor T2 is coupled to the second electrode of the second transistor, and the second electrode of the second transistor T2 is coupled to the node N1. A first terminal of the capacitor C1 is coupled to the node N1, and a second terminal of the capacitor C1 is coupled to a second power source ELVSS. The control end of the third transistor T3 is coupled to the node N1, the first electrode of the third transistor T3 is coupled to the first power source ELVDD, and the second electrode of the third transistor T3 is coupled to an anode of the OLED. A cathode of the OLED is coupled to the second power source ELVSSO. Preferably, the control end may be a grid of each of the transistors T1 to T3, the first electrode may be a source of each of the transistors T1 to T3, and the second electrode may be a drain of each of the transistors T1 to T3. Similarly, the control end of each of the transistors T4, T5 and T6 may be a grid of each of the transistors T4 to T6, the first electrode may be a drain of each of the transistors T1 to T3, and the second electrode may be a drain of each of the transistors T1 to T3.

Figure 3:
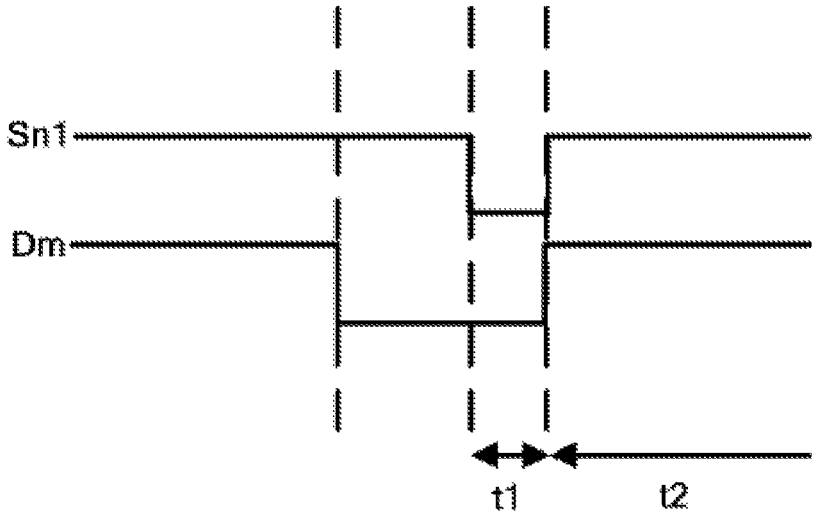
FIG. 3 is a signal timing diagram of a method for driving the pixel circuit as shown in FIG. 2.

FIG. 3 shows a signal timing diagram for a method for driving the pixel circuit 200 as shown in FIG. 2. The signal timing as shown in FIG. 3 includes a first phase and a second phase, wherein the first phase t1 is a data writing phase, and the second phase t2 is a normal light-emitting phase. As all the transistors T1 to T3 in the pixel circuit 200 as shown in FIG. 2 are described using PMOS transistors as an example, the transistors are conducted when low-level signals are applied to the control ends of the transistors.

As shown in FIG. 3, in the first phase, i.e., a time period t1 in which the scanning signals are applied to the scanning line Sn1, the first transistor T1 and the second transistor T2 respond to the low-level scanning signals Sn1 to be conducted. Therefore, the data signals Vdata from the data line Dm are provided to the node N1 via the first transistor T1 and the second transistor T2. It can be understood that, at this point, the voltage value at the node N1 is a voltage value corresponding to a differential value between the data signals Vdata and the threshold voltage of the first transistor T1, i.e., Vdata-$|V_{TH1}|$, which is equivalent to Vdata+$V_{TH1}$. Further, the voltage at the node N1 is also stored in the capacitor C1. That is, the data signals Vdata on the data line Dmare are read into the pixel circuit 200.

In the second phase t2, that is, after the voltage of the first scanning line Sn1 jumps to a high level, the OLED enters the normal light-emitting phase. At this point, a current of the first power source ELVDD flows through the third transistor T3 into the anode of the OLED.

The driving current flowing into the OLED is shown as a formula below:

$$I_{OLED}=\tfrac{1}{2}\mu_3\times C_{ox3}\times W_3/L_3\times(V_{GS3}-V_{TH3})^2 \quad \text{(Formula 2)},$$

wherein $\mu_3$ is a carrier mobility of the third transistor T3; $C_{ox3}$ is a capacitance of a control end oxidation layer per unit area of the third transistor T3, $W_3$ is a channel width of the third transistor, and $L_3$ is a channel length of the third transistor T3. $V_{GS3}$ is a voltage difference between the grid and the source of the third transistor T3, and $V_{TH3}$ is the threshold voltage of the third transistor T3.

At this point, as the third transistor is conducted, the voltage $V_{GS3}$ for the grid and the source is the voltage (Vdata+$V_{TH1}$) at the node N1, and the voltage difference between the voltage $V_{GS3}$ and the voltage Vdd of the first power source is Vdata+$V_{TH1}$−Vdd. Therefore, through calculation in the above formula, the following formula may be obtained:

$$I_{OLED}=\tfrac{1}{2}\mu_3\times C_{ox3}\times W_3/L_3\times(V_{data}+V_{TH1}-V_{dd}-V_{TH3})^2 \quad \text{(Formula 3)}.$$

It follows that the impact of the threshold voltage of the third transistor T3 to the driving current of OLED may be reduced by arranging the first transistor T1 with appropriate electric characteristics.

Preferably, if the transistors T1 and T3 with similar electrical characteristics as much as possible are arranged, the threshold voltage of the third transistor T3 can be offset to almost zero, thereby allowing the driving current flowing into the OLED to be free from the impact of the threshold voltage of the third transistor T3. That is, the current value of the OLED is as follows:

$$I_{OLED}=\frac{1}{2}\mu_3\times C_{ox3}\times W_3/L_3\times(V_{data}-V_{dd})^2 \quad \text{(Formula 4).}$$

Wherein for the arrangement of the first transistor T1 and the third transistor T3 with similar electrical characteristics as much as possible, two transistors approximate in channel width and channel length as much as possible may be arranged, and are arranged in the pixel circuit 200 in a close range.

Preferably, the pixel circuit 200 may also be arranged on a TFT backplane, with the first and third transistors T1 and T3 symmetrically arranged, so that the threshold voltages of the first and third transistors T1 and T3 are as close as possible.

Figure 4:
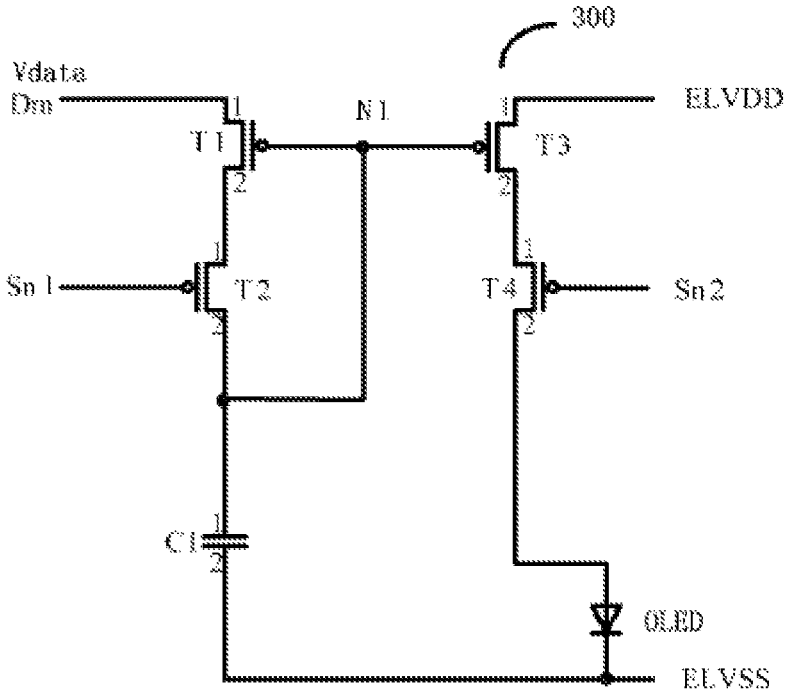
FIG. 4 is a schematic diagram of a pixel circuit according to a second embodiment of the present invention.
Figure 5:
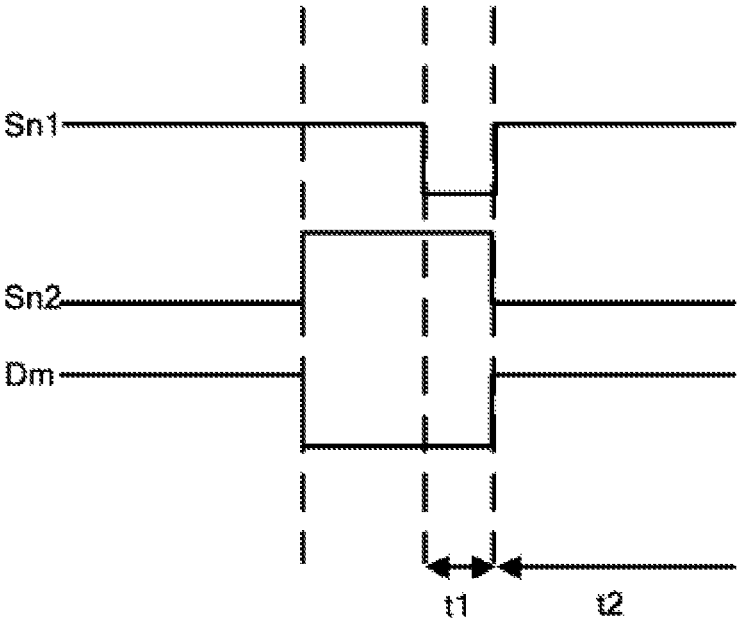
FIG. 5 is a signal timing diagram of a method for driving the pixel circuit as shown in FIG. 4.

FIG. 4 shows a schematic diagram of a pixel circuit 300 according to a second embodiment of the present invention. Compared with the pixel circuit as shown in FIG. 2, the pixel circuit 300 further comprises a fourth transistor T4; wherein a control end of the fourth transistor T4 is coupled to a second scanning line Sn2 configured to receive a second scanning signal from the second scanning line Sn2, a first electrode of the fourth transistor T4 is coupled to the second electrode of the third transistor T3, and a second electrode of the fourth transistor T4 is coupled to the anode of the OLED FIG. 5 shows a signal timing diagram of a drive method according to the pixel circuit 300 as shown in FIG. 4. Compared with the signal timing diagram as shown in FIG. 3, the signal timing diagram as shown in FIG. 4 is different in that the scanning signal is provided to the second scanning line Sn2 in the second phase t2. At this point, the third transistor T3 and the fourth transistor T4 are conducted simultaneously, thereby providing the data signals to the OLED through the third transistor T3 and the fourth transistor T4. Furthermore, the OLED enters the normal light-emitting phase.

It can be understood that as the fourth transistor T4 is arranged in the pixel circuit 300, the conduction time and the shutdown time of the fourth transistor T4 may be controlled through the second scanning line Sn2, thereby controlling the light-emitting time of the OLED through the fourth transistor T4. That is, when the transistor T4 is shut down, the OLED does not emit light; and when the transistor T4 is conducted, the OLED emits light. The OLED in the pixel circuit 200 as shown in FIG. 2 is always in a light-emitting state since the third transistor T3 is conducted continuously. Therefore, the light-emitting effect of the pixel circuit 3 becomes more stable.

Figure 6:
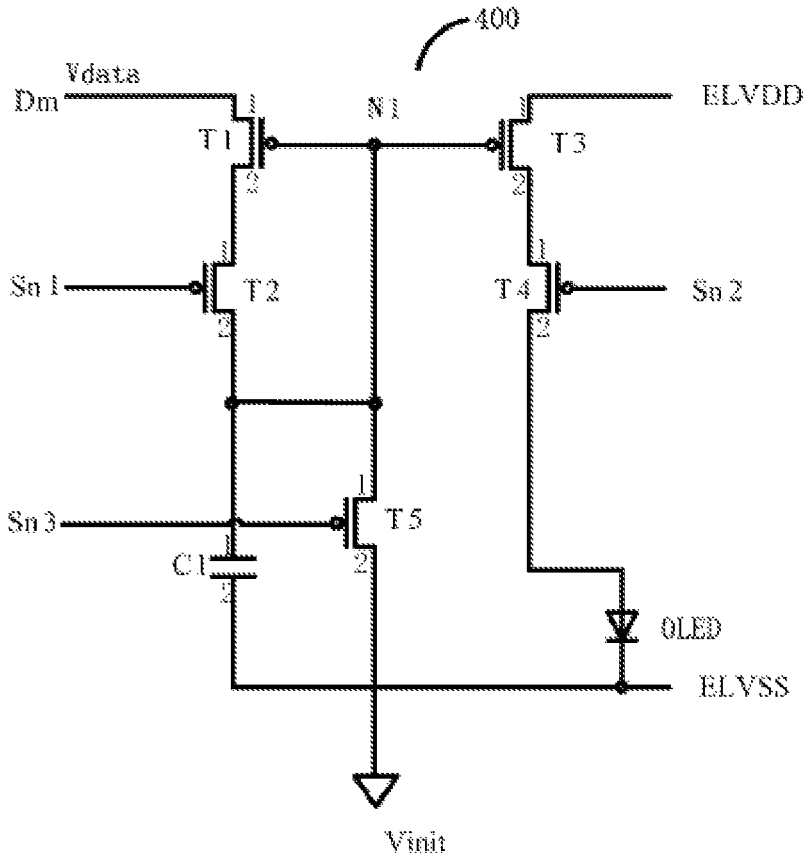
FIG. 6 is a schematic diagram of a pixel circuit according to a third embodiment of the present invention.

FIG. 6 shows a schematic diagram of a pixel circuit 400 according to a third embodiment of the present invention. Compared with the pixel circuit 300 as shown in FIG. 4, the pixel circuit 400 further comprises a fifth transistor T5; wherein a control end of the fifth transistor T5 is coupled to a third scanning line Sn3 configured to receive a third scanning signal from the third scanning line Sn3, a first electrode of the fifth transistor T5 is coupled to the node N1, and a second electrode of the fifth transistor T5 is coupled to the third power source. The voltage Vinit of the third power source is not higher than $V_{ELVSS}$.

For those skilled in the art, it can be understood that when the value of Vinit is equal to that of $V_{ELVSS}$, the source electrode of the fifth transistor can be coupled to the second power source ELVSS.

Figure 7:
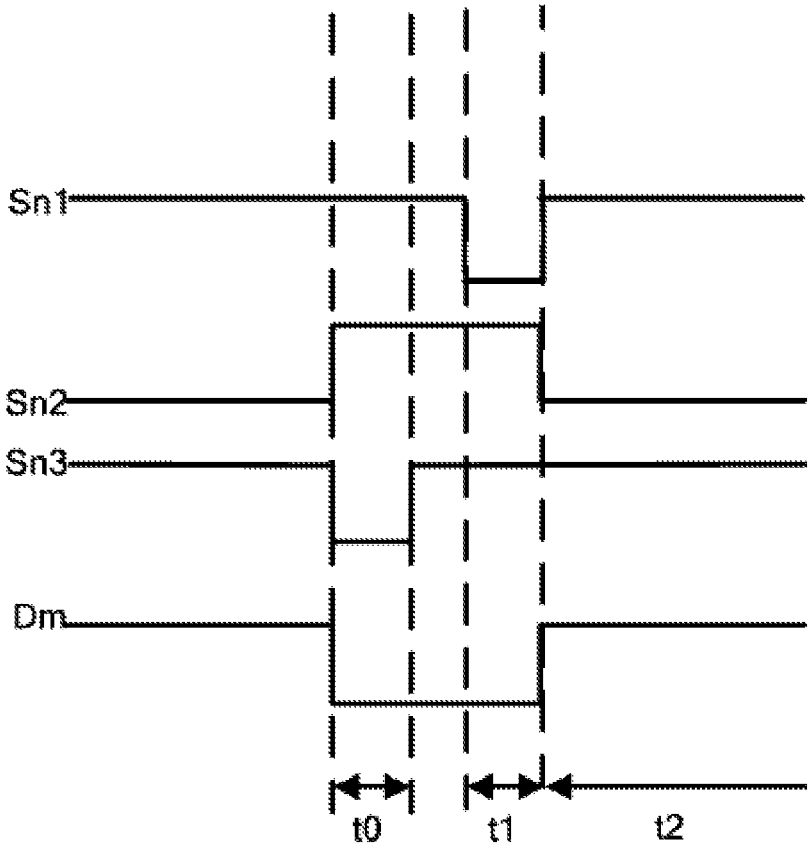
FIG. 7 is a signal timing diagram of a method for driving the pixel circuit as shown in FIG. 6.

FIG. 7 shows a signal timing diagram of a pixel circuit 400 as shown in FIG. 6. The signal timing further comprises an initialization phase before the first phase.

In the initialization phase, i.e., the time period t0 in which the scanning signals are provided to the scanning line Sn3, the fifth transistor T5 is conducted, thereby supplying the voltage of the third power source Vinit to the node N1 and the anode of the OLED.

That is, the fifth transistor T5 supplies a constant voltage to the node N1 and the anode of the OLED in the initialization time period. Thus, the voltage at the node N1 and the voltage of the capacitor C1 are initialized to be Vinit.

Preferably, the initialized voltage Vinit may be set to be the same as the voltage of the second power source ELVSS.

Figure 8:
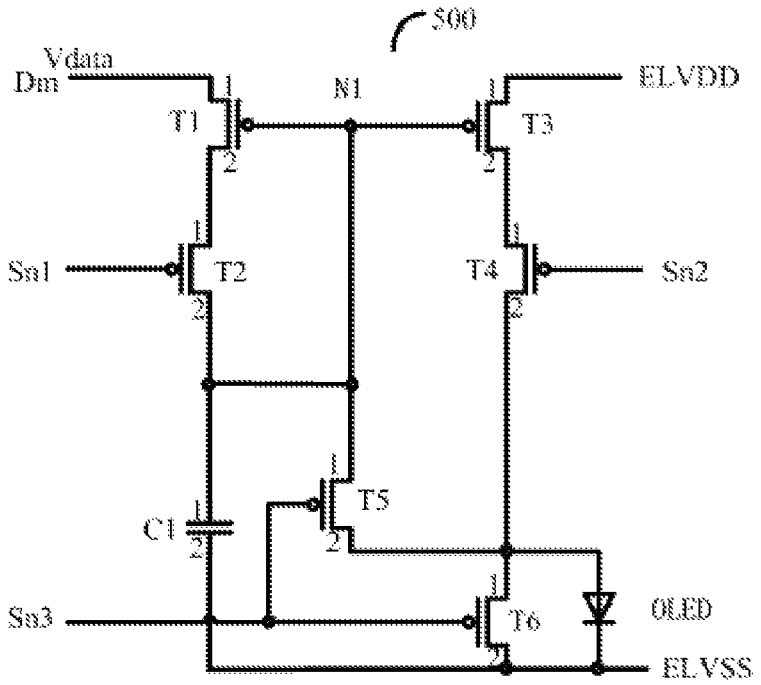
FIG. 8 is a schematic diagram of a pixel circuit according to a fourth embodiment of the present invention.

FIG. 8 shows a schematic diagram of a pixel circuit 500 according to the fourth embodiment of the present invention. Compared with the circuit as shown in FIG. 6, the pixel circuit 500 further comprises a sixth transistor T6.

The sixth transistor T6 is coupled between the anode of the OLED and the second power source ELVSS. A control end of the sixth transistor T6 and the control end of the fifth transistor T5 are jointly coupled to the scanning line Sn3 configured to receive a third scanning signal; and a first electrode and a second electrode of the sixth transistor T6 are respectively coupled to the anode and the cathode of the OLED. In the time period in which the low-level scanning signal is provided to the scanning line Sn3, the sixth transistor T6 is conducted. Since the first and second electrodes of the sixth transistor T6 are respectively coupled to the anode and the cathode of the OLED, the driving current may be prevented from being supplied to the OLED.

Figure 9:
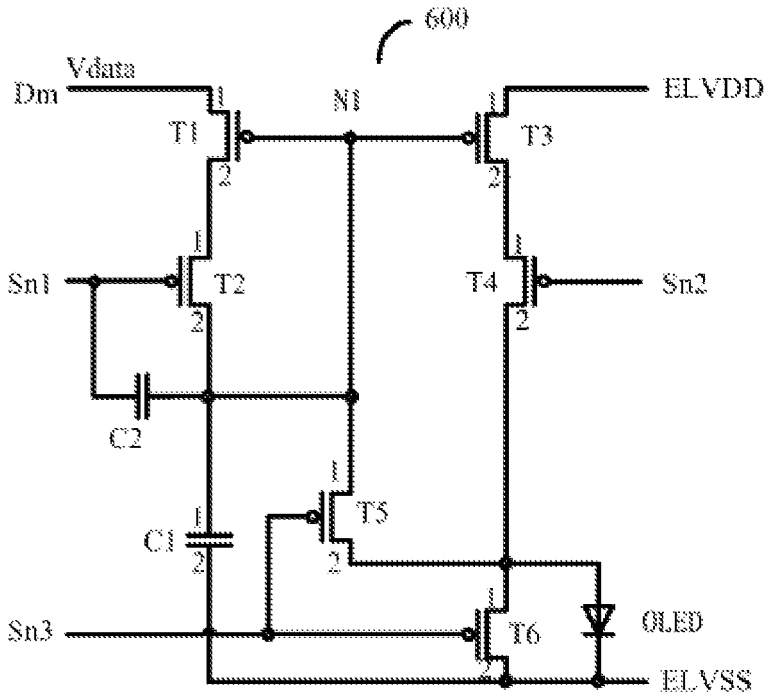
FIG. 9 is a schematic diagram of a pixel circuit according to a fifth embodiment of the present invention.

FIG. 9 shows a schematic diagram of a pixel circuit 600 according to a fifth embodiment of the present invention. Compared with the circuit as shown in FIG. 7, the pixel circuit 600 further comprises a second capacitor C2. The second capacitor C2 is coupled between the control end of the second transistor T2 and the node N1.

It can be understood that in the time period in which the scanning signal of the scanning line Sn1 jumps from low level to high level, since Vdata is stored in the node N1, the voltage increases the potential of the node N1 through the coupling effect of the second capacitor C2 when the voltage of the scanning line Sn1 turns into high level, thereby correspondingly improving the voltage Vdata+$V_{TH1}$ of the control end of the third transistor T3 and storing the corresponding voltage into the second capacitor C2. Due to Vdata<Vdd, from the formula 4, it can be known that the increase in the voltage value of the control end of the third transistor T3 results in the decrease of the differential value between the voltage of the control end of the third transistor T3 and Vdd. Therefore, when the voltage of the data signals, read into the pixel circuit 600, is very small, i.e. when the grayscale for light emitting is very low, the driving current flowing through the OLED is made to decrease further, thereby improving the contrast among different grayscales of the pixel circuit.

It is necessary to note that the first transistor T1, the second transistor T2, the third transistor T3, the fourth transistor T4, the fifth transistor T5, and the sixth transistor T6 in the pixel circuits of the embodiments above are described by using the P-channel metal-oxide semiconductor transistor as an example. Those skilled in the art may understand that the transistors T1 to T6 in the pixel circuit of the present invention may also be implemented by using N-channel metal-oxide semiconductor transistors.

Figure 10:
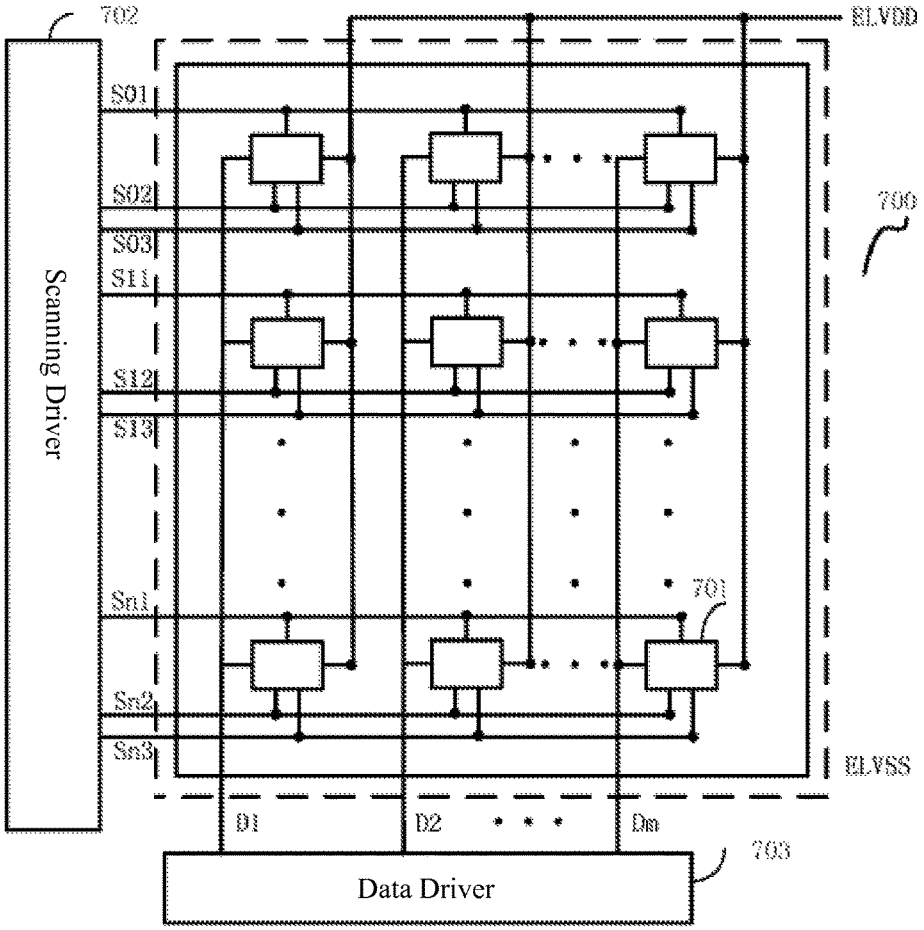
FIG. 10 is a schematic diagram of an active matrix organic light-emitting display device of the present invention.

FIG. 10 shows an active matrix organic light-emitting display device 600 comprising the pixel circuit according to the embodiments of the present invention.

With reference to FIG. 10, a display device 700 comprises: a first power source ELVDD, a second power source ELVSS, a scanning driver 702, a data driver 703, and a plurality of pixel circuits 701 arranged in intersection areas between the scanning lines Sn1, Sn2 and Sn3 and the data lines D1 to Dm in a matrix manner. The first power source ELVDD and the second power source ELVSS supply corresponding power voltages to the plurality of pixel circuits 701 through corresponding row lines (with the number of n) and column lines (with the number of m).

Each pixel circuit 701 is coupled to the corresponding scanning line (for example, Sn2, Sn2 and Sn3) and data line respectively. For example, the pixel circuit 701 located in the row i and the column j is coupled to the scanning lines Si1, Si2 and Si3 of the row i and the data line Dj of the column j.

The scanning driver 702 generates the scanning signals corresponding to the scanning signals provided externally (for example, by a certain control unit). The scanning signals generated by the scanning driver 702 are respectively provided to the pixel circuits 701 in sequence through the scanning lines Si1 to Sin.

The data driver 703 generates the data signals corresponding to the data and data control signals provided externally (for example, by a certain control unit). The data signals generated by the data driver 703 are provided to the pixel circuit 701 through the data lines D1 to Dm in synchronization with the scanning signals, wherein the pixel circuit 701 may be any one pixel circuit as shown in the embodiments above. It can be understood that the number of the scanning lines in each row may be differently arranged accordingly according to different embodiments of the pixel circuit.

Although the present invention is described with reference to specific exemplary embodiments, it should be understood that the present invention is not limited to such embodiments. However, the present invention intends to cover various modifications and equivalent arrangements made under the spirit and scope of the claims and equivalents thereof.

The embodiments above are only used for describing the technical solutions of the present invention instead of limiting the present invention. Although the present invention is described in detail with reference to preferred embodiments, those of ordinary knowledge in the related technical field may make some modifications and polishments without departing from the spirit and scope of the present invention. Therefore, the protection scope of the present invention should be subject to that defined by the claims.

What is claimed is:

1. A pixel circuit, comprising: a first power source, a second power source, an organic light-emitting diode, a first capacitor, a first transistor, a second transistor, and a third transistor; wherein a cathode of the organic light-emitting diode is connected to the second power source;

the first capacitor is connected between a node and the second power source; and each of the first transistor, the second transistor, and the third transistor is provided with a control end, a first electrode, and a second electrode; wherein the control end of the first transistor is connected to the node, and the first electrode of the first transistor is configured to receive a data signal, the data signal is provided to the node via the first transistor and the second transistor, and the voltage value at the node is equivalent to the sum of a voltage of the data signal and a threshold voltage of the first transistor;

the control end of the second transistor is configured to receive a first scanning signal, the first electrode of the second transistor is connected to the second electrode of the first transistor, and the second electrode of the second transistor is connected to the node;

the control end of the third transistor is connected to the node, the first electrode of the third transistor is connected to the first power source, and the second electrode of the third transistor is connected to an anode of the light-emitting diode; and the first transistor is configured to compensate a threshold voltage of the third transistor.

2. The pixel circuit according to claim 1, wherein the first transistor and the third transistor are approximate in channel width, and are arranged in the pixel circuit closely.

3. The pixel circuit according to claim 2, wherein:

the pixel circuit is arranged on a TFT backplane; and the first transistor and the third transistor are arranged with identical electronic properties on the TFT backplane, and the first transistor and the third transistor are provided with identical threshold voltage.

4. The pixel circuit according to claim 1, further comprising a fourth transistor; wherein, a control end of the fourth transistor is configured to receive a second scanning signal, a first electrode of the fourth transistor is connected to the second electrode of the third transistor, and a second electrode of the fourth transistor is connected to an anode of the light-emitting diode.

5. The pixel circuit according to claim 1, further comprising a fifth transistor and a third power source;

wherein the fifth transistor comprises: a control end configured to receive a third scanning signal, a first electrode connected to the node, and a second electrode connected to the third power source.

6. The pixel circuit according to claim 5, wherein a voltage of the third power source is lower than or equal to a voltage of the second power source.

7. The pixel circuit according to claim 5, further comprising a sixth transistor;

wherein the sixth transistor comprises: a control end configured to receive the third scanning signal, a first electrode connected to the anode of the light-emitting diode, and a second electrode connected to the second power source.

8. The pixel circuit according to claim 1, further comprising a second capacitor connected between the control end of the second transistor and the node.

9. The pixel circuit according to claim 1, wherein:

the first transistor, the second transistor, the third transistor, the fourth transistor, the fifth transistor, and the sixth transistor are P-channel metal-oxide semiconductor transistors.

10. A method for driving a pixel circuit according to claim 1, the drive method comprising:

applying the first scanning signal to a first scanning line for conducting the second transistor such that data signals from data lines are provided to the node via the first transistor and the second transistor, and storing a voltage at the node in the storage capacitor, wherein the control end of the first transistor and a terminal of the storage capacitor are jointly connected to the node, and the voltage value at the node is equivalent to the sum of a voltage of the data signal and a threshold voltage of the first transistor;

providing the voltage at the node through the third transistor to the light-emitting diode; and emitting, by the light-emitting diode, light with a brightness matching the data signals.

11. The drive method according to claim 10, wherein:

the pixel circuit further comprises a fourth transistor; and the method further comprises:

applying a second scanning signal to a second scanning line for conducting the fourth transistor such that the data signals are provided to the light-emitting diode via the third transistor.

12. The drive method according to claim 11, wherein:

the pixel circuit further comprises a fifth transistor; and a third scanning signal is applied for conducting the fifth transistor before the first scanning signal is applied, thereby initializing the node.

13. The drive method according to claim 10, wherein the first transistor and the third transistor are approximate in channel width, and are arranged in the pixel circuit closely.

14. The drive method according to claim 13, wherein:

the pixel circuits are arranged on a TFT backplane; and the first transistor and the third transistor are arranged on the TFT backplane, and the first transistor and the third transistor are provided with identical threshold voltage.

15. A display device, comprising:

a scanning driver, configured to apply a scanning signal to a scanning line;

a data driver, configured to apply a data signal to a data line; and a pixel circuit connected between the data lines and scanning lines;

wherein the pixel circuit comprises: a first power source, a second power source, an organic light-emitting diode, a first capacitor, a first transistor, a second transistor, and a third transistor, wherein the organic light-emitting diode comprises a cathode which is connected to the second power source, and the diode further comprises an anode;

the first capacitor is connected between a node and the second power source;

each of the first transistor, the second transistor, and the third transistor is provided with a control end, a first electrode, and a second electrode;

wherein the control end of the first transistor is connected to the node, and the first electrode of the first transistor is connected to the data line, data signals from the data line are provided to the node via the first transistor and the second transistor and the voltage value at the node is equivalent to the sum of a voltage of the data signal and a threshold voltage of the first transistor;

the control end of the second transistor is connected to a first scanning line, the first electrode of the second transistor is connected to the second electrode of the first transistor, and the second electrode of the second transistor is connected to the node;

the control end of the third transistor is connected to the node, the first electrode of the third transistor is connected to the first power source, and the second electrode of the third transistor is connected to an anode of the light-emitting diode; and the first transistor is configured to compensate a threshold voltage of the third transistor.

16. The display device according to claim 15, wherein the first transistor and the third transistor are approximate in channel width, and are arranged in the pixel circuit closely.

17. The display device according to claim 16, wherein:

the display device further comprises a TFT backplane, the pixel circuit being arranged on the TFT backplane; and the first transistor and the third transistor are arranged on the TFT backplane, and the first transistor and the third transistor are provided with identical threshold voltage.

18. The display device according to claim 15, further comprising a fourth transistor; wherein a control end of the fourth transistor is connected to a second scanning line, a first electrode of the fourth transistor is connected to the second electrode of the third transistor, and a second electrode of the fourth transistor is connected to the anode of the light-emitting diode.

19. The display device according to claim 15, further comprising a fifth transistor and a third power source;

wherein the fifth transistor comprises: a control end connected to a third scanning line, a first electrode connected to the node, and a second electrode connected to the third power source.

20. The display device according to claim 19, wherein a voltage of the third power source is lower than or equal to a voltage of the second power source.

21. The display device according to claim 19, further comprising a sixth transistor;

wherein the sixth transistor comprises a control end connected to the third scanning line jointly, a first electrode connected to the anode of the light-emitting diode, and a second electrode connected to the second power source.

22. The display device according to claim 15, further comprising a second capacitor connected between the control end of the second transistor and the node.

23. The display device according to claim 15, wherein the first transistor, the second transistor, the third transistor, a fourth transistor, a fifth transistor, and a sixth transistor are P-channel metal-oxide semiconductor transistors.

* * * * *